United States Patent [19]

Masel

[11] 4,352,458

[45] Oct. 5, 1982

[54] SATURATED VAPOR GUN

[75] Inventor: Ruben Masel, Kiron, Israel

[73] Assignee: Koor Metals Ltd., Holon, Israel

[21] Appl. No.: 167,353

[22] Filed: Jul. 10, 1980

Related U.S. Application Data

[63] Continuation of Ser. No. 871,938, Jan. 24, 1978, abandoned.

[51] Int. Cl.[3] ..... B05B 7/06

[52] U.S. Cl. ..... 239/77; 239/2 R

[58] Field of Search ..... 239/2, 77, 8, 13, 71, 239/73, 128, 130, 172, 179

[56] References Cited

U.S. PATENT DOCUMENTS 2,587,965 3/1952 Campbell ..... 239/77

2,886,249 5/1959 Sidlow ..... 239/77

*Primary Examiner*—James B. Marbert

*Attorney, Agent, or Firm*—Browdy and Neimark

[57] ABSTRACT

A vapor generating gun on a movable support comprises a combustion chamber having an inlet for receiving fuel and pressurized air and an outlet for the hot gases of combustion under pressure, a secondary inlet providing a flow of pressurized air adjacent the outlet and a water injector providing a spray of water in the path of the hot gases. A tertiary air inlet may also provide a flow of air adjacent the water ejector.

9 Claims, 3 Drawing Figures

SATURATED VAPOR GUN

This is a continuation, of application Ser. No. 871,938 filed Jan. 24, 1978, now abandoned.

FIELD OF THE INVENTION

The present invention relates to apparatus for prevention of frost damage to crops such as fruit trees.

BACKGROUND OF THE INVENTION

It is well known that frost conditions are bettered by the loss of heat through infra-red radiation of wavelengths in the range of 8–12 microns from the earth's surface and crops growing thereon to the atmosphere. The heat loss occurs particularly on windless clear nights. The distribution of temperature as a function of height above the ground surface under the typical frost conditions described above is illustrated in FIG. 1, which indicates that the air temperature reaches a minimum at a height of 10–20 ft. above the ground surface. The layer of atmospheric air at which the temperature is at a minimum is commonly referred to as the "inversion layer."

It is known that heat losses to the atmosphere from the ground surface during clear and windless nights are in the range of 600,000 KCAL/hectare/hour.

A variety of techniques are known for combatting frost damage to crops. The most popular of these is the use of surface combusion heaters. These involve the disadvantage that a large number of heaters, typically 100 per hectare, must be used to provide good coverage and that the fuel requirements comprise a caloric content approximately four times that of the heat losses to the atmosphere per unit time. The labour involved in operating such a large number of heaters as well as the cost of fuel render frost protection by conventional techniques a very expensive operation.

An alternative technique for preventing frost damage to crops is to create turbulence in the atmosphere so as to force the inversion layer downwards adjacent the ground surface, and thus below the regions of the fruit trees on which growing fruit is to be found. Such turbulence can be provided by means of a large motor-operated fans or jets or by a combination of the heaters and fans. This system is generally believed to be impracticable due to the high cost involved.

Another alternative technique for protecting crops against frost damage is direct water sprinkling wherein the radiation losses to the atmosphere are partially compensated for by latent heat produced by freezing of the water drops. This technique suffers from the serious disadvantage that significants amounts of ice, having a conductivity four times that of water, are formed on the crops, for example, on the leaves of fruit trees. Therefore the ice thus formed enhances the cooling of the leaves, which is undesirable.

Smoke generators have also been used for preventing radiation losses, but these are not satisfactory due to the fact that the size of the smoke particles, 0.5–0.6 microns makes them completely transparent to infra-red radiation.

Apparatus is also known for providing freeze protection with man-made fog. As described in Sunshine State Agricultural Research Report Vol. 19, No. 1–2 of March, 1974 and in a brochure issued by Mee Industries Inc. 4939 North Earl Street, Rosemead, Calif. and entitled "Freeze Protection," a fog is generated using a series of nozzles each of which sprays water from a small hole under a pressure of 500–600 PSI. A temperature increase of 1°–7° F. is said to be provided. The nozzles are arranged in fixed locations along supply conduits which are mounted at desired intervals throughout a growing area.

In the above-referred to Sunshine State Agricultural Research Report there is found a description of a system which generates fog by evaporating water, recondensing and coating the fog droplets with a layer of cetyl alcohol to prevent them from evaporating. According to the research report, this technique generated fog particles having droplets of too small a size and insufficient density to significantly reduce the radiation heat losses encountered.

SUMMARY OF THE INVENTION

The present invention seeks to overcome disadvantages of the prior art techniques and systems described herein above and to provide a frost protection technique which is significantly less expensive than and at least as effective as any of the prior art techniques.

There is thus provided in accordance with an embodiment of the invention movable vapour generating apparatus comprising a movable support; a vapour generating gun and apparatus for mounting the vapour generating gun on the movable support.

Further in accordance with an embodiment of the invention the mounting apparatus comprises a rotatable mounting assembly permitting rotation of the outlet of the vapour generating gun in a plane generally parallel to the ground surface.

There is also provided in accordance with an embodiment of the invention a method for preventing frost damage to growing crops comprising the steps of providing a vapour generator on a movable platform; operating the vapour generator to provide a vapour mist; and moving the vapour generator from one location to another in a manner so as to maintain a cloud of the vapour in a desired orientation with respect to said growing crops over a desired amount of time.

Additionally in accordance with an embodiment of the invention there is provided a vapour generator for providing a heated vapour mist comprising a combustion chamber defining an inlet for receiving fuel and air under pressure and an outlet for the exit of water vapour and hot gases of combustion under pressure surrounded by air under pressure; a secondary pressurized air inlet provides the pressurized air surrounding the stream of the hot gases; and a water injector provides the flow of water spray with the stream of hot gases.

Further in accordance with an embodiment of the invention a tertiary air inlet may provide a flow of air around the stream of pressurized air at the outlet.

BRIEF DESCRIPTION OF THE DRAWINGS

The invention will be more fully understood and appreciated from the following description taken in conjunction with the drawings in which.

DETAILED DESCRIPTION OF THE INVENTION

Figure 2:
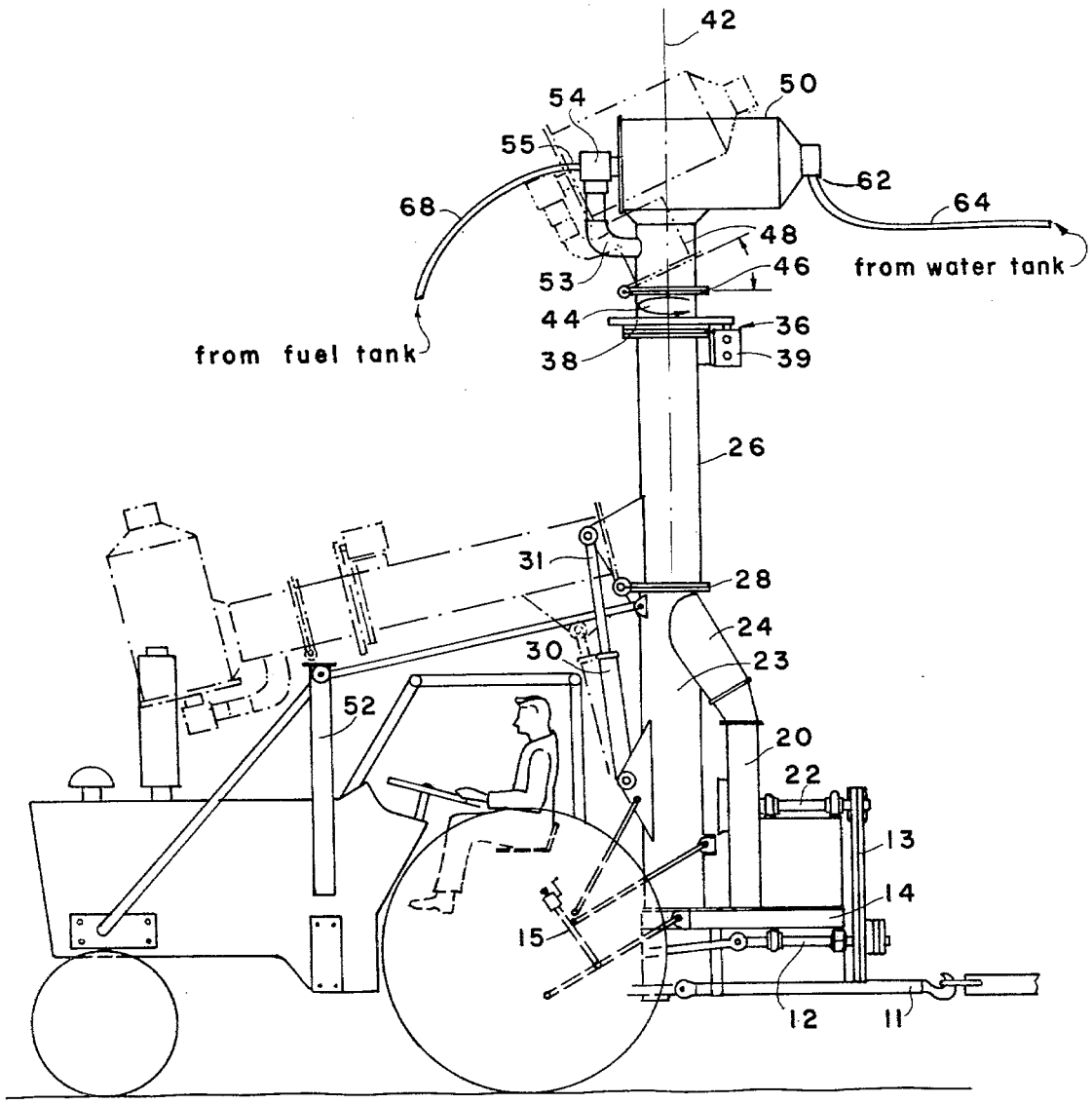
FIG. 2 is a plan side-view illustration of vapour generating apparatus constructed and operative in accordance with an embodiment of the invention.
Figure 3:
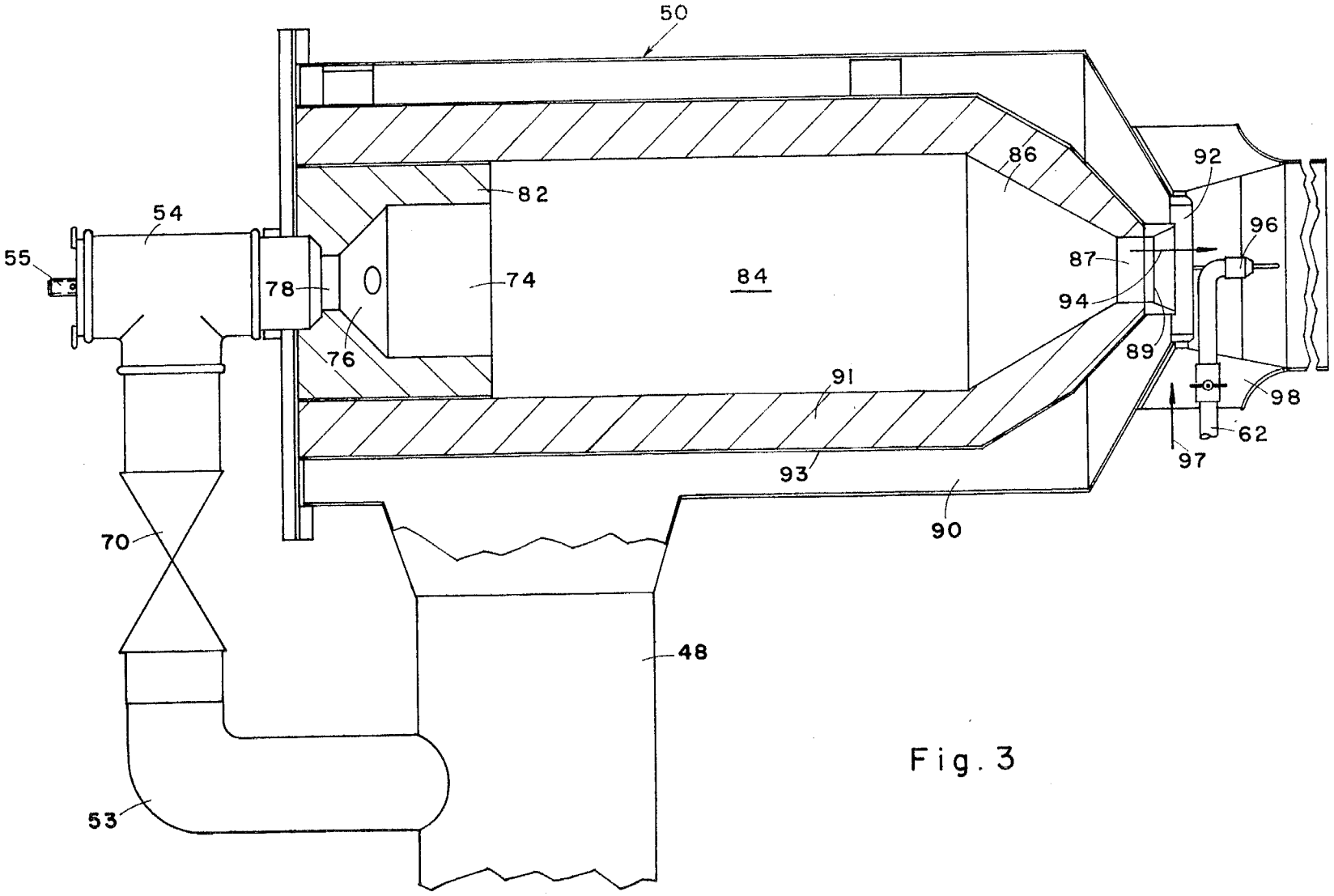
FIG. 3 is a detailed sectional illustration of a vapour generating gun forming part of the apparatus of FIG. 2.

Referring now to FIGS. 2 and 3 there is seen vapour generating apparatus comprising a gun element 50 rotatably mounted onto an air passageway 26. Air passageway 26 is in turn hinged onto a vertical air flow conduit 23 by means of a hinged coupling 28. Air flow conduit 23 is mounted on a support structure 14 which is mounted in a desired orientation onto the conventional three point hitch of a tractor. The orientation of the support structure 14 may be determined by manually adjusting the position of the mounting hitch as by means of a crank arrangement 15.

A drive shaft 12 is coupled to the power take-off of the tractor and transmits power via power-drive belts 13 to a second drive shaft 22 which is coupled to a fan (not shown) driving a blower 20. Air flow conduit 23 receives the pressurized air output of blower 20 via a channel 24.

The uppermost end of conduit 23 is coupled to passageway 26 via hinged coupling 28 in order to permit passageway 26 and gun 50 to be stored or transported in a lowered orientation when not in use. When lowered, passageway 26 and gun 50 are supported by supports 52 fixedly attached onto the tractor. The orientation of passageway 26 is determined by the operation of a hydraulic drive cylinder 30 whose cooperating piston 31 is pivotably mounted onto passageway 26. The apparatus is shown in its operating orientation by solid lines in FIG. 2 and in its lowered orientation in phantom lines.

Disposed at the uppermost portion of passageway 26 is a rotatable coupling assembly 36 which comprises a rotatable sleeve seal 38 and driving means 39 such as an electric motor mounted onto sleeve seal 38 for moving the sleeve relative to passageway 26. The operation of driving means 39 enables rotation of sleeve seal 38 about a generally vertical axis 42 which is selected to be the longitudinal axis of passageway 23.

Fixedly attached to sleeve 38 for rotation together therewith and relative to passageway 26 is a joining element 44 which is in turn attached to one end of a bendable coupling element 46. An air conduit and mounting element 48 is attached to the opposite end of coupling 46. Supported on element 48 is vapor gun 50 which will be described in detail hereinafter in connection with FIG. 3. A branch air communication conduit 53 communicates between the interior of element 48 and a primary air inlet 54 to gun 50.

Figure 1:
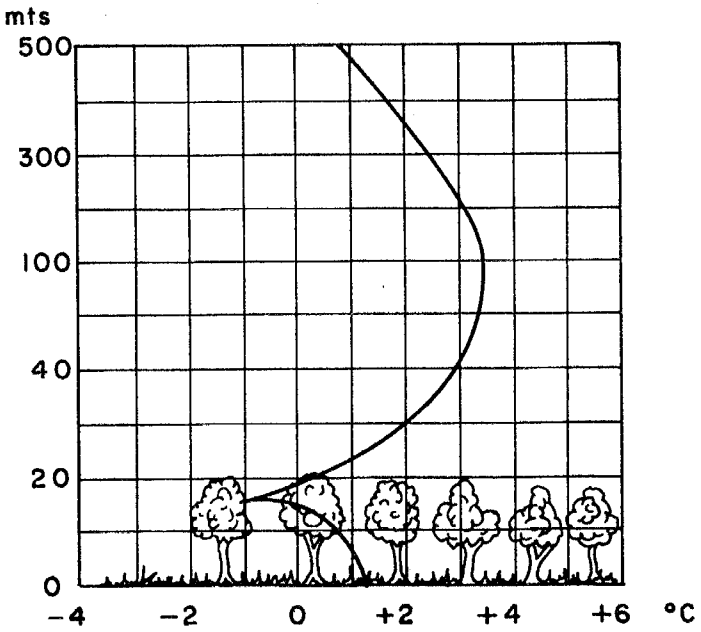
FIG. 1 is a diagram showing air temperature as a function of height above the ground surface for a clear, windless night.

It is noted that the relative angular orientation of the opposite sides of bendable coupling 46 enables the angular disposition of gun 50 to be selectably determined. Two alternative angular orientations of the gun are illustrated in FIG. 1. A generally horizontal position is indicated in solid lines while an alternative disposition in which the gun is orientated upwardly by an angle of approximately 25° is indicated in phantom.

In accordance with a preferred embodiment of the invention gun 50 is positioned approximately 5 meters above the ground surface. It is appreciated that this height may be varied to any suitable height depending on the operating conditions and the type of crops to be protected.

A water tank typically of capacity 1500 liters may be disposed on a trailer (not shown) and coupled to the tractor as by a hitch 11. The tank communicates with a water inlet opening 62 to gun 50 via a conduit 64. A fuel tank (not shown) typically of capacity 600 liters may also be mounted on the trailer and communicates with a fuel inlet 55 typically disposed coaxially and centrally of primary air inlet 54, via a conduit 68. A water pump (not shown) of capacity 20 liters per minute is associated with conduit 64 while a fuel pump (not shown), typically of capacity 60 kilograms per hour is associated with conduit 68.

Reference is now made to FIG. 3 which illustrates a vapour generating gun usable in the embodiment of FIG. 1 2. Branch conduit 53 communicates with primary air inlet 54 via a valve 70. Primary inlet 54 extends to a combustion chamber 74 which is formed to have a generally truncated conical entrance portion 76 and a neck portion 78 leading thereto from primary inlet 54. Fuel inlet 55 extends interiorly of primary air inlet 54 and also communicates with combustion chamber 74. Combustion chamber 74 is surrounded by an insulative material 82 such as $Al_2O_3$, Aluminum Oxide. Combustion chamber 74 opens into an elongated chamber 84 which extends into a narrowing truncated conical passage 86 extending longitudinally forward of combustion chamber 74. Passageway 86 terminates in a channel 87 which leads to a nozzle 89.

During operation of the apparatus, a fuel and air mixture passes from air inlet 54 into combustion chamber 74 where it is ignited, producing hot gases which exit through nozzle 89. Surrounding chamber 84, passageway 86 and channel 87 is a layer 91 of insulative material, typically an insulator such as Aluminum Oxide $Al_2O_3$. The insulative material is covered in turn with a layer of stainless steel 93. Surrounding the layer of stainless steel is a secondary air flow jacket 90 which communicates with air conduit 48 and has an outlet just beyond the outlet of nozzle 89 at a location indicated generally by reference numeral 92.

The combined flows of hot gases and air continue in a direction indicated generally by an arrow 94 and pass a water injector 96 which is coupled to inlet 62. Water injector 96 provides a fine spray of water droplets (average size 70 microns) in the path of the hot gases. A tertiary flow of air is drawn in by the moving stream of hot gases in a direction 97 through a tertiary air inlet 98. Alternatively, the tertiary air inlet may be omitted. The contact of the water droplets with the hot gases causes partial vaporization of the water droplets and thus produces a stream of water vapour and water droplets of average size 10 microns under pressure from an outlet 100.

In accordance with a typical embodiment of the invention, a jet 60 meters long having an end velocity of 2 meters per second is produced by the gun. A flow rate of 75 cubic meters of water vapour through outlet 100 is produced with a consumption of 1 kilogram of fuel per minute and 20 liters of water per minute.

It may be appreciated that during operation of the invention the vapor generating gun 50 rotates about axis 42. The rotation may be unidirectional or back and forth and in any desired pattern.

It is a particular feature of the present invention that a relatively large area of growing crops may be protected with a relatively small investment in machinery and manpower due to the mobile nature of the vapor generating apparatus. Since the vapor generated has a useful lifetime measured in hours, it may be appreciated that duty cycles or regeneration of a vapor cloud in each given area may be selected so as to maximize the amount of area protected by the use of a single vapor generated gun.

It is appreciated that in accordance with an alternative embodiment of the invention the vapour generating gun may be used for purposes other than frost damage prevention. For example, insecticides may be dispensed by the gun in the version shown or in a modified version. The long range of the gun can enable it to be used for spraying by aircraft for example.

It will be appreciated by persons skilled in the art that while only a single embodiment of the invention has been described and shown in detail as an example, there is no intention to limit the invention to the particular embodiment shown and described. Therefore the invention is defined only by the claims which follow.

I claim:

1. In vapor generating apparatus, a vapor generating gun comprising a combustion chamber; combustion chamber air and fuel inlets;

a combustion chamber outlet duct including an outlet nozzle having a circular cross section of reduced diameter through which nozzle the hot gases produced in the combustion chamber exit in the form of a jet of hot gases;

a water spray generator located in said duct so that the water spray generated therein is at least partially vaporized by said exiting jet hot gases;

a source of pressurized air; and a substantially annular conduit connected to said source of pressurized air and located to produce an annular stream of pressurized air which substantially envelopes said jet of hot gases and the vaporized water spray therein, condenses at least part of said vaporized water and entrains same within the jet of hot gases, and transports over substantial distances the jet of hot gases and entrained vaporized and condensed water.

2. In vapor generating apparatus, a vapor generating gun according to claim 1 and furthermore comprising air coupling means for coupling said combustion chamber air inlet and said annular conduit to said source of pressurized air.

3. In vapor generating apparatus, a vapor generating gun according to claim 2 and furthermore comprising a sleeve surrounding and spaced from an outer wall of said combustion chamber, a first end of said sleeve communicating with said air coupling means; a second and opposite end of said sleeve communicating with said annular conduit.

4. In vapor generating apparatus, a vapor generating gun according to claim 3 wherein walls of said duct are formed with additional air inlets through which air is drawn upon the flow of hot gases through said duct.

5. Vapor generating apparatus comprising support means; a vapor generating gun according to claim 1 articulated to said support means so as to enable rotational displacement of said outlet duct.

6. Vapor generating apparatus comprising support means; a vapor generating gun according to claim 4 articulated to said support means so as to permit rotational displacement of said outlet duct.

7. Vapor generating apparatus according to claim 5 wherein said support means is readily displaceable.

8. A vapor generating apparatus including a vapor generating gun comprising:

a combustion chamber including means to effect combustion of fuel therein;

means to feed air to said combustion chamber;

means to feed fuel to said combustion chamber;

exit means to pass hot gases produced in said combustion chamber therefrom, said exit means comprising an outlet duct from said combustion chamber;

means to use the hot gases passing through said outlet duct to partially vaporize a water spray to provide a mixed stream of water vapor and water droplets, comprising a water injector means located adjacent said outlet duct and generally coaxial therewith, and means to pass a spray of water therethrough to provide a water spray exiting said injector means; and means for forming a pressurized air envelope to entrain and transport in substantially jet form the partially vaporized water spray, said means comprising a substantially annular air outlet passageway surrounding said hot gases exit means, and means to feed air under pressure through said annular air outlet passageway.

9. Vapor generating apparatus, comprising:

a source of compressed air, combustion chamber means having an inlet and an outlet displaced from said inlet, means for supplying compressed air from said source to said inlet, said outlet including nozzle means to provide a jet of heated gases, water spray ejector means located to supply a spray of water in the jet of heated gases, and means for surrounding said jet of heated gases with a jet of compressed air from said source.

* * * * *

UNITED STATES PATENT AND TRADEMARK OFFICE

CERTIFICATE OF CORRECTION

PATENT NO. : 4,352,458

DATED : Oct. 5, 1982

INVENTOR(S) : Ruben Masel

It is certified that error appears in the above-identified patent and that said Letters Patent are hereby corrected as shown below:

On the Patent Cover Sheet delete "[75] Inventor: Ruben Masel, Kiron, Israel" and insert therefore --[75] Inventors: Ruben Masel, Kiron, Israel; Jacob Gil, Kiron, Israel--.

Signed and Sealed this

First Day of March 1983

[SEAL]

*Attest:*

GERALD J. MOSSINGHOFF

*Attesting Officer*

*Commissioner of Patents and Trademarks*